US007992733B2

(12) United States Patent
Laliberte et al.

(10) Patent No.: US 7,992,733 B2
(45) Date of Patent: Aug. 9, 2011

(54) ASSIST SYSTEM CONFIGURED FOR MOVING A MASS

(75) Inventors: Thierry Laliberte, Quebec (CA); Clement Gosselin, Quebec (CA); Simon Foucault, Quebec (CA); Dalong Gao, Troy, MI (US); Robert J. Scheuerman, Washington, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 61 days.

(21) Appl. No.: 12/627,383

(22) Filed: Nov. 30, 2009

(65) Prior Publication Data

US 2011/0127230 A1 Jun. 2, 2011

(51) Int. Cl.
*B66C 13/18* (2006.01)

(52) U.S. Cl. ..... 212/279; 212/197; 212/320; 700/213

(58) Field of Classification Search ..... 212/197, 212/279, 320; 700/213
See application file for complete search history.

(56) References Cited

U.S. PATENT DOCUMENTS

| | | | | | |
|---|---|---|---|---|---|
| 456,361 | A * | 7/1891 | Graves | 212/320 |
| 672,576 | A * | 4/1901 | Tannett-Walker | 212/320 |
| 672,577 | A * | 4/1901 | Tannet-Walkeer | 212/320 |
| 3,344,933 | A * | 10/1967 | Jelatis et al. | 212/285 |
| 5,324,163 | A * | 6/1994 | Costa | 414/751.1 |
| 5,489,032 | A * | 2/1996 | Mayhall et al. | 212/285 |
| 6,022,002 | A * | 2/2000 | Niggli | 254/273 |
| 6,612,449 | B1 * | 9/2003 | Otani et al. | 212/317 |
| 6,886,811 | B2 * | 5/2005 | Springett et al. | 254/264 |
| 7,185,774 | B2 * | 3/2007 | Colgate et al. | 212/331 |
| 7,837,674 | B2 * | 11/2010 | Cooper | 606/1 |
| 7,856,930 | B2 * | 12/2010 | Zaguroli, Jr. | 105/29.1 |
| 2008/0023430 | A1 * | 1/2008 | Andreasson | 212/271 |

* cited by examiner

*Primary Examiner* — Thomas J. Brahan
(74) *Attorney, Agent, or Firm* — Quinn Law Group, PLLC

(57) ABSTRACT

An assist system is configured for moving a mass vertically, along a Z axis. The assist system includes a vertical actuation system, a cable, a plurality of pulleys, an actuator, and a mass. The pulleys are operatively attached to the support structure and an assist device that is movable attached to the support structure. The cable is routed around each of the pulleys and attached to the support structure. One of the pulleys supports the mass. The mass moves vertically in response to the actuator.

20 Claims, 6 Drawing Sheets

ASSIST SYSTEM CONFIGURED FOR MOVING A MASS

TECHNICAL FIELD

The present invention relates to an assist system that is configured for moving a mass in a vertical direction.

BACKGROUND OF THE INVENTION

Overhead bridge cranes are widely used to lift and relocate large payloads. Generally, the displacement in a pick and place operation involves three translational degrees of freedom and a rotational degree of freedom along a vertical axis. This set of motions, referred to as a Selective Compliance Assembly Robot Arm ("SCARA") motions or "Schönflies" motions, is widely used in industry. A bridge crane allows motions along two horizontal axes. With appropriate joints, it is possible to add a vertical axis of translation and a vertical axis of rotation. A first motion along a horizontal axis is obtained by moving a bridge on fixed rails while the motion along the second horizontal axis is obtained by moving a trolley along the bridge, perpendicularly to the direction of the fixed rails. The translation along the vertical axis is obtained using a vertical sliding joint or by the use of a belt. The rotation along the vertical axis is obtained using a rotational pivot with a vertical axis.

There are partially motorized versions of overhead bridge cranes that are displaced manually along horizontal axes and rotated manually along the vertical axis by a human operator, but that include a motorized hoist in order to cope with gravity along the vertical direction. Also, some bridge cranes are displaced manually along all of the axes, but the weight of the payload is compensated for by a balancing device in order to ease the task of the operator. Such bridge cranes are sometimes referred to as assist devices. Balancing is often achieved by pressurized air systems. These systems need compressed air in order to maintain pressure or vacuum—depending on the principle used—which requires significant power. Also, because of the friction in the cylinders, the displacement is not very smooth and can even be bouncy. Balancing can be achieved using counterweights, which add significant inertia to the system. Although helpful and even necessary for the vertical motion, such systems attached to the trolley of a bridge crane add significant inertia regarding horizontal motion. In the case of balancing systems based on counterweights, the mass added can be very large, even larger than the payload itself. If the horizontal traveling speed is significant, the inertia added to the system becomes a major drawback.

There are also fully motorized versions of such bridge cranes that require powerful actuators, especially for the vertical axis of motion which has to support the weight of the payload. These actuators are generally attached to the trolley or bridge and are then in motion. The vertical translation actuator is sometimes attached to the bridge and linked to the trolley by a system similar to what is used in tower cranes.

SUMMARY OF THE INVENTION

A vertical actuation system includes a cable, a plurality of assist device pulleys, a mass pulley, a fixed pulley and an actuation pulley. The cable has a first end and a second end. The first end is configured for operative attachment to a support structure at a first location and the second end is configured for operative attachment to the support structure at a second location, different from the first location. The assist device pulleys are configured for operative attachment to an assist device that is movably attached to the support structure. The cable is configured to be routed around each of the plurality of assist device pulleys, the mass pulley, the fixed pulley, and the actuation pulley such that each of the pulleys are configured to be operatively disposed between the first and second ends of the cable. The mass pulley is configured to be operatively supported by the cable and a pair of the plurality of assist device pulleys. The fixed pulley is configured for operative attachment to the support structure. The actuation pulley is configured to be operatively supported by the cable and each of the fixed pulley and the second end of the cable. A mass extends from the mass pulley. An actuator is configured to move the cable relative to the fixed pulley such that the actuation pulley moves vertically, relative to the ground, as the mass pulley and the mass move vertically in an opposite direction. The vertical movement of the mass is configured to be independent of the horizontal movement of the assist device.

In another embodiment, an assist system is configured to statically balance a mass in a vertical direction along a Z axis, relative to the ground. The assist system includes a support structure, an assist device, a cable, a plurality assist device pulleys, a mass pulley, a fixed pulley, and an actuation pulley. The assist device is movably attached to the support structure and is configured for horizontal movement along at least one of an X axis and a Y axis, relative to the ground. The cable has a first end and a second end. The first end is operatively attached to the support structure at a first location and the second end is operatively attached to the support structure at a second location, different from the first location. The assist device pulleys are operatively attached to the assist device. The cable is configured to be routed around each of the plurality of assist device pulleys, the mass pulley, the fixed pulley, and the actuation pulley such that each of the pulleys are operatively disposed between the first and second ends of the cable. The mass pulley is operatively supported by the cable and a pair of the plurality of assist device pulleys. The fixed pulley is operatively attached to the support structure. The actuation pulley is operatively supported by the cable and each of the fixed pulley and the second end of the cable. A mass extends from the mass pulley. An actuator is configured to move the cable relative to the fixed pulley such that the actuation pulley moves vertically, relative to the ground, as the mass pulley and the mass move vertically in an opposite direction. The vertical movement of the mass is independent of the horizontal movement of the assist device.

In another embodiment, an assist system includes a cable, a plurality of pulleys, a mass, and a variable balancing system. The cable has a first end and a second end. The first end is configured for operative attachment to a support structure at a first location and the second end is configured for operative attachment to the support structure at a second location, different from the first location. The pulleys are configured for operative attachment to at least one of the support structure and an assist device that is movably attached to the support structure. The cable is configured to be routed around each of the plurality of pulleys. One of the pulleys is configured to be operatively supported by the cable. The mass is configured to extend from the one of the plurality of pulleys. Another one of the pulleys is configured to be operatively supported by the cable. The variable balancing system is configured to be operatively attached to another one of the pulleys. The variable balancing system includes a balance platform, a lever, a balancing actuator, and a counterweight. The lever is pivotally attached to the balance platform about a balance axis. The balancing actuator is disposed along the lever. The counterweight is operatively attached to the balancing actuator such that the counterweight is configured to move a distance along the balancing actuator between a minimum position and a maximum position. The minimum position corresponds to the mass having a minimum weight such that the mass is statically balanced along the Z axis. The maximum position corresponds to the mass having a maximum weight such that the mass is statically balanced along the Z axis.

The above features and advantages and other features and advantages of the present invention are readily apparent from the following detailed description of the best modes for carrying out the invention when taken in connection with the accompanying drawings.

BRIEF DESCRIPTION OF THE DRAWINGS

Referring now to the figures, which are exemplary embodiments and wherein like elements are numbered alike.

DESCRIPTION OF THE PREFERRED EMBODIMENTS

Figure 1:
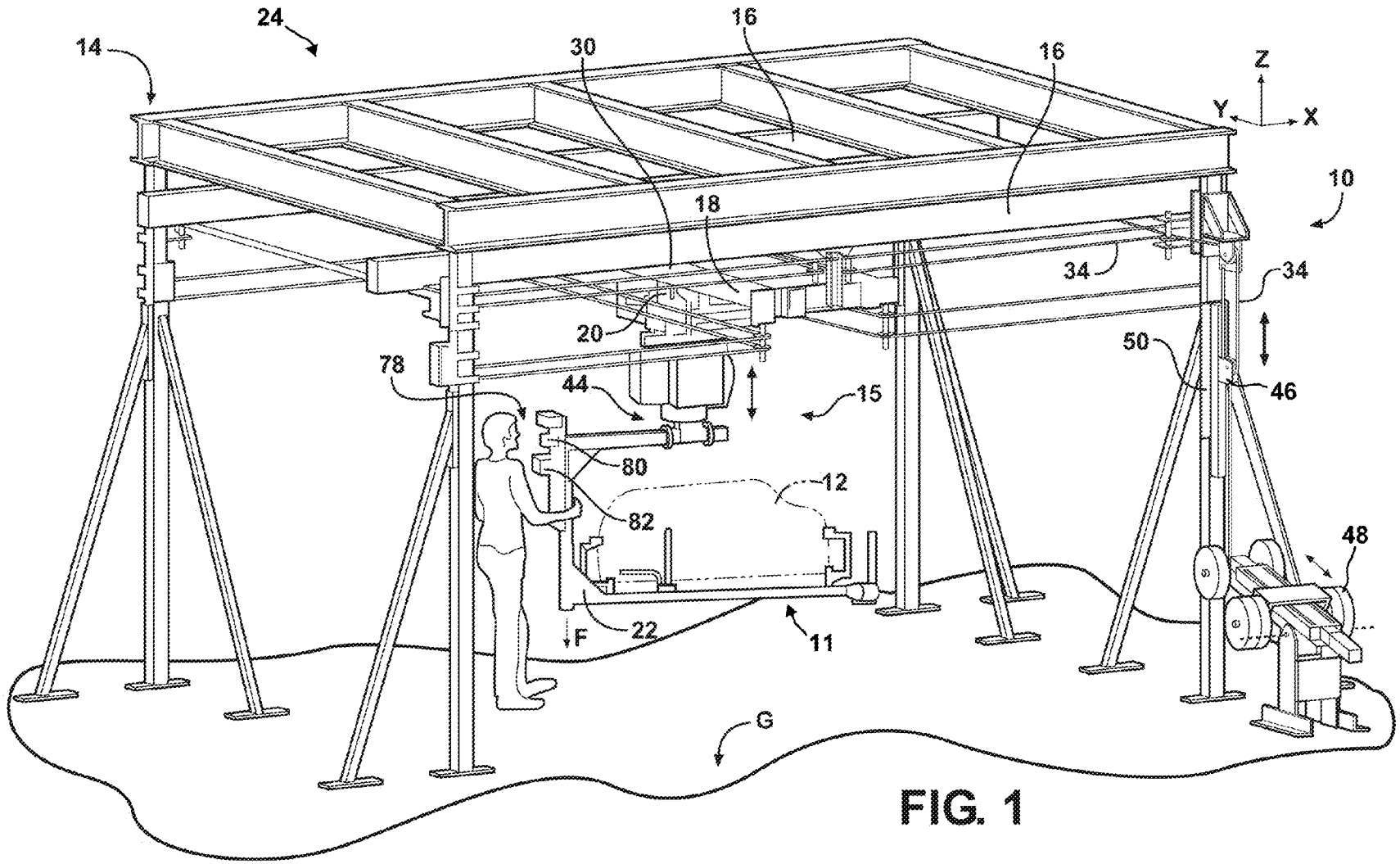
FIG. 1 is a schematic perspective view of an assist system including a vertical actuation system and a variable balancing system operatively connected to a support structure.

Referring to the drawings, wherein like reference numbers refer to like components, an assist system is shown at 24 in FIG. 1. The assist system 24 includes a vertical actuation system 46, a stationary support structure 14, an assist device 15, and a mass 11. The vertical actuation system 46 is configured for moving the mass 11 in a vertical direction along a Z axis, relative to the ground G, is shown at 10 in FIG. 1. The vertical actuation system 46 is mounted to the stationary support structure 14 that is configured to at least partially support the vertical actuation system 46, the assist device 15, and the mass 11. The mass 11 may include an end effector 22, where the end effector 22 is supported by the assist device 15. The end effector 22 may selectively support a payload 12. The support structure 14 includes, but is not limited to, a pair of parallel rails 16 or runway tracks. Generally, an assist device 15 is supported by the parallel rails 16 of the support structure 14. The assist device 15 may include a bridge crane 18 and a trolley 20. The bridge crane 18 is a structure that includes at least one girder 30 that spans the pair of parallel rails 16. The bridge crane 18 is adapted to carry the payload 12 horizontally, relative to the ground G, along an X axis. The trolley 20 is movably attached to the girders 30 of the bridge crane 18 such that the trolley 20 is adapted to carry the payload 12 horizontally, relative to the ground G, along a Y axis. The end effector 22 is rotatably attached to the trolley 20 such that the end effector 22 rotates about the Z axis. The Z axis extends in a generally vertical direction, relative to the ground G. Additionally, the end effector 22 movably extends from the trolley 20 such that the end effector 22 is adapted to carry or support the payload 12 in the generally vertical direction along the Z axis.

Figure 2:
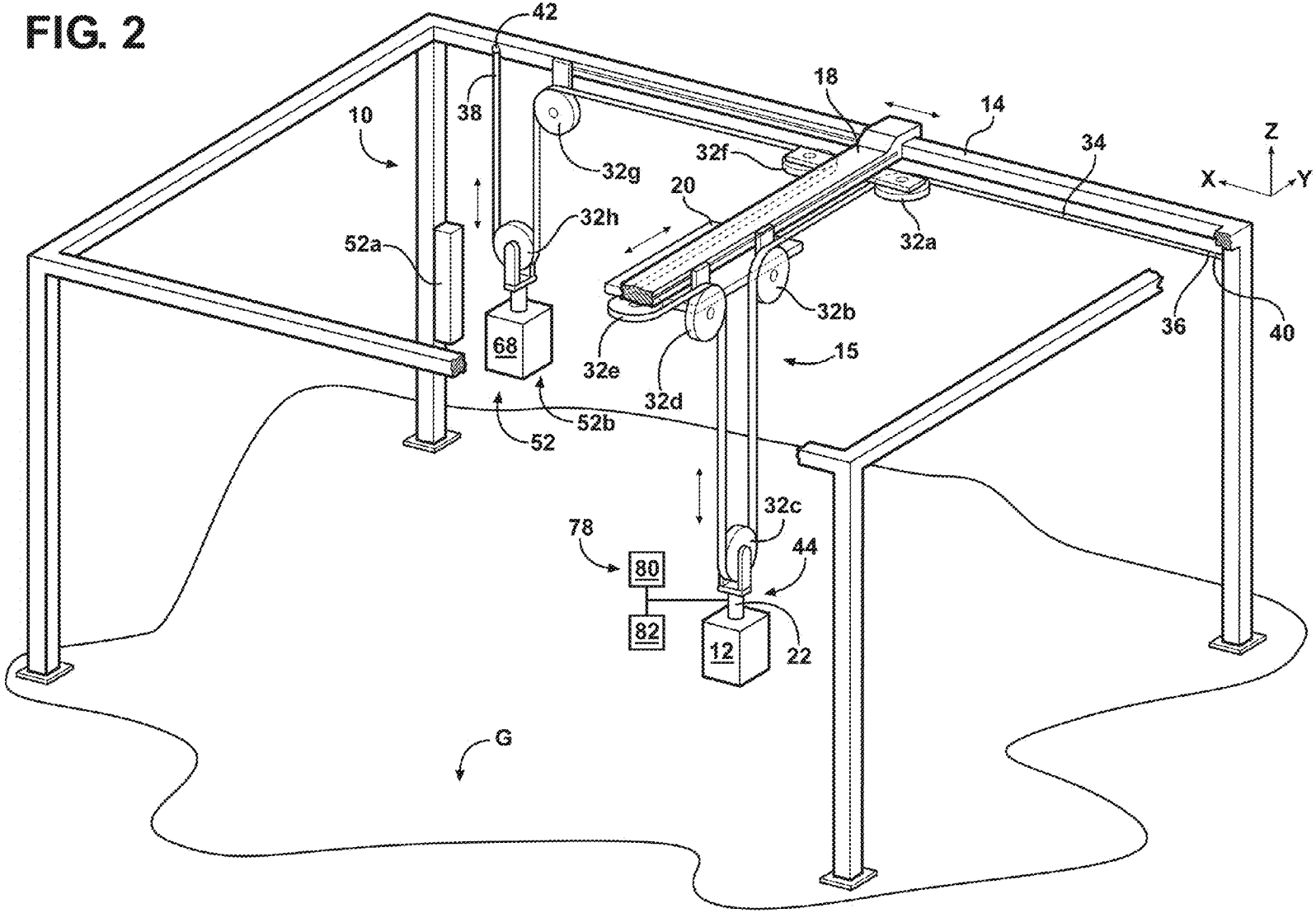
FIG. 2 is a schematic perspective view of the vertical actuation system of FIG. 1, configured for vertically moving a mass along a Z axis.

Referring to FIG. 2, the vertical actuation system 46 allows motion of the end effector 22, and any associated payload 12, along the Z axis. Movement along the Z axis is decoupled from horizontal movement of the assist device 15 along the X and Y axes. This means that the vertical movement of the assist device 15, via the vertical actuation system 46, is decoupled from the horizontal movements of the end effector 22 and any associated payload 12, along the X and Y axes. To decouple the vertical movements from the horizontal movements, the vertical actuation system 46 is disposed in spaced relationship to the assist device 15 and the mass 11. This means that the vertical actuation system 46 may be attached to the support structure 14 and/or the ground G so that any mass associated with movement of the vertical actuation system 46 does not move horizontally with the assist device 15 and inertia of the system is reduced. The vertical actuation system 46 will be described in more detail below.

Referring again to FIG. 2, first, second, third, fourth, fifth, sixth, seventh, and eighth pulleys 32*a*-32*h* are shown. The pulleys 32*a*-32*h* include a plurality of assist device pulleys 32*a*, 32*b*, 32*d*-32*f*. The assist device pulleys 32*a*, 32*b*, 32*d*-32*f* include the first pulley 32*a* that operatively extends from the bridge crane 18, the second and fourth pulleys 32*b*, 32*d* that extend from the trolley 20, and the fifth and sixth pulleys 32*e*, 32*f* extend from the bridge crane 18. The end effector 22 includes the third pulley, or mass pulley, 32*c*. The seventh pulley, or fixed pulley, 32*g* extends from the support structure 14. The eighth pulley, or actuation pulley, 32*h* is operatively attached to the vertical actuation system 46. It should be appreciated that the total number of pulleys 32*a*-32*h* is not limited to the eight described herein as any other number of pulleys 32*a*-32*h* may be used as known to those skilled in the art. A cable 34 has a first end 36 and a second end 38. The first end 36 of the cable 34 is operatively attached, or anchored, to the support structure 14 at a first fixed location 40. The second end 38 of the cable 34 is operatively attached, or anchored, to the support structure 14 at a second fixed location 42. The cable 34 is routed to extend from the first fixed location 40 and to then be routed around the first pulley 32*a* and then the second pulley 32*b*. The end effector 22 includes a vertical rotational joint 44 that operatively interconnects the end effector 22 and the trolley 20. The vertical rotational joint 44 is configured to allow rotation of the end effector 22, and any associated payload 12, about the Z axis while preventing the cable 34 from also rotating. The vertical rotational joint 44 includes the third pulley 32*c* and the cable 34 is routed from the second pulley 32*b*, around the third pulley 32*c*, and then around the fourth pulley 32*d*. The cable 34 is next routed around the fifth, sixth, and seventh pulleys 32*e*, 32*f*, 32*g*, respectively. The cable 34 is routed around the eighth pulley 32*h* such that the eighth pulley 32*h* is at least partially supported by the seventh pulley 32*g* and the second fixed location 42 of the second end 38 of the cable 34. It should be appreciated that the routing of the cable 34 between pulleys 32*a*-32*h* is not limited to the eight described herein as any other suitable configuration of the cable 34 and the pulleys 32*a*-32*h* may be used as known to those skilled in the art.

Figure 3:
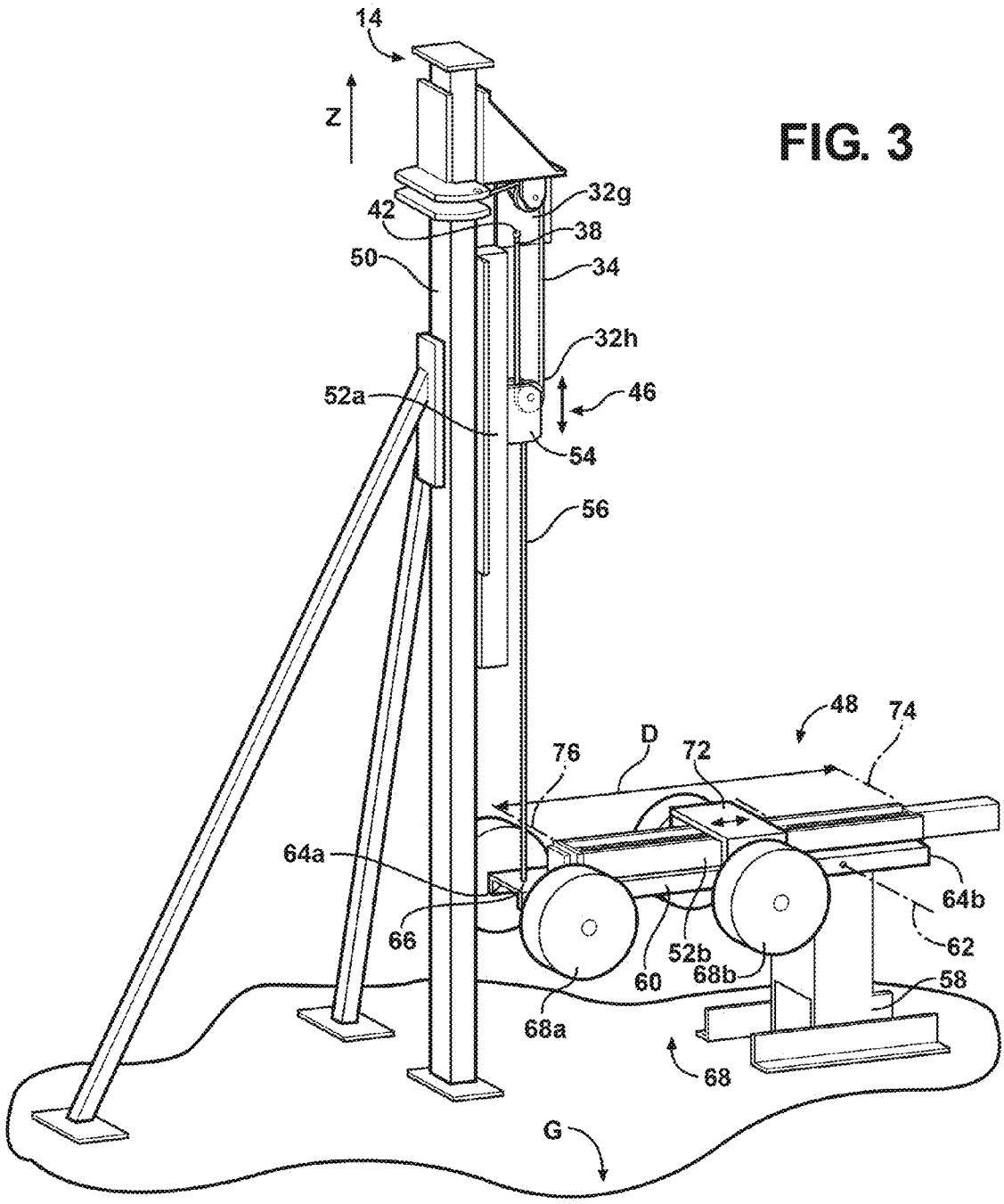
FIG. 3 is a schematic perspective view of the vertical actuation system and the variable balancing system of FIG. 1.

Referring to FIG. 3, the vertical actuation system 46 may be operatively disposed on the support structure 14. More specifically, the vertical actuation system 46 may be disposed on a vertically extending leg 50 of the support structure 14. It should be appreciated, however, that the vertical actuation system 46 is not limited to being mounted to the support structure 14, but may be mounted to any other object that does not move in the horizontal direction with the assist device 15.

Referring to FIG. 3, the vertical actuation system 46 includes a vertical actuator 52*a* that is operatively attached to the support structure 14. A vertical slide 54 is operatively attached to the vertical actuator 52*a*. The vertical slide 54 is configured to move along the vertical actuator 52*a* in response to actuation of the vertical actuator 52*a*. The vertical actuator 52*a* may be configured with a transmission that supplies a large transmission ratio. The large transmission ratio provides translational motion to the end effector 22, and any association payload 12, via the cable 34 that is routed around each of the pulleys 32*a*-32*h*. In one embodiment, the transmission of the vertical actuator 52*a* includes a ball screw. In addition to providing a large transmission ratio, the ball screw is configured to control a speed that the end effector 22, and any associated payload 12, moves vertically along the Z axis. However, it should be appreciated that the vertical actuator 52*a* is not limited to using a ball screw, as any other transmission, known to those skilled in the art, may also be used. Additionally, a brake may be operatively connected to the vertical actuator 52*a* to slow down and/or stop the vertical actuator 52*a*. Additionally, the brake may allow the vertical slide 54 to be in a locked position relative to the vertical actuator 52*a* when transporting the end effector 22, and any associated payload 12, horizontally along the X and/or Y axes to prevent movement of the end effector 22, and any associated payload 12, along the Z axis.

It should be appreciated that the routing of the cable 34 among the pulleys 32*a*-32*h* is not limited to that as described herein. It is possible to modify a transmission ratio between the vertical motion of the end effector 22, and any associated payload 12, and the motion of the vertical actuator 52*a* and the variable balancing system 48 by changing the cable 34 routing and/or the number and location of the pulleys 32*a*-32*h*, as known to those skilled in the art.

The variable balancing system 48 may be disposed on the ground G. The variable balancing system 48 is configured to provide a counterbalance to the end effector 22, and any associated payload 12, such that the end effector 22, and any associated payload 12, is statically balanced along the Z axis. Statically balanced means that the end effector 22, and any associated payload 12, may selectively move along the Z axis in response to operating the vertical actuation system 46 and/or application of a vertical force F to the end effector 22, and any associated payload 12, as will be described in more detail below. However, when the operation of the vertical actuation system 46 is stopped, the end effector 22, and any associated payload 12, generally remains in the same vertical position along the Z axis as they are "statically balanced". A balancing cable 56 operatively interconnects the vertical actuation system 46 and the variable balancing system 48. More specifically, at one end, the balancing cable 56 is operatively connected to the vertical slide 54. The balancing cable 56 may be a cable 34, a belt, a chain, or any other object or device configured to interconnect the vertical actuation system 46 and the variable balancing system 48, as known to those skilled in the art.

As shown in FIG. 3, the variable balancing system 48 includes a balance platform 58 and a lever 60 that is pivotally attached to the balance platform 58 such that the lever 60 pivots about a balance axis 62. The lever 60 has opposing ends 64*a*, 64*b* and the balancing cable 56 is operatively attached to the lever 60 at an attachment point 66 near one of the opposing ends 64*a*, 64*b*. At least one counterweight 68 is operatively attached to the lever 60. In the embodiment shown in FIG. 3, there is a fixed counterweight 68*a* and a mobile counterweight 68*b*. It should be appreciated, however, that more or less counterweights 68 may be used, as known to those skilled in the art. The fixed counterweight 68*a* may be disposed on the lever 60, proximate the attachment point 66 of the balancing cable 56. A balancing actuator 52*b* may be disposed along the lever 60. A balancing slide 72 may be operatively attached to the balancing actuator 52*b* and the mobile counterweight 68*b* may be operatively attached to the balancing slide 72. The balancing slide 72, along with the mobile counterweight 68*b*, is configured to move a distance D along the balancing actuator 52*b* between a minimum position 74 and a maximum position 76 to counter the weight associated with the end effector 22, and any associated payload 12 and statically balance the end effector 22, and any associated payload 12. When the mobile counterweight 68*b* is at the minimum position 74, the mobile counterweight 68*b* is moved along the lever 60 such that the mobile counter weight is closer to the balance axis 62 than when the mobile counterweight 68*b* is at the maximum position 76. The position of the mobile counterweight 68*b* at the minimum position 74, the maximum position 76, or at any other position between the minimum and maximum positions 74, 76, are configured to statically balance the end effector 22, and any associated payload 12, along the Z axis. Therefore, when the mobile counterweight 68*b* is at the minimum position 74, the end effector 22 may not be supporting a payload 12, or may be supporting a minimum payload 12, i.e., the payload 12 having a minimum weight for the design of the variable balancing system 48, while remaining statically balanced along the Z axis. Likewise, when the mobile counterweight 68*b* is at the maximum position 76, the end effector 22 is supporting a maximum payload 12, i.e., the payload 12 having a maximum weight for the design of the variable balancing system 48, while remaining statically balanced along the Z axis. However, the mobile counterweight 68*b* may also be positioned anywhere along the lever 60 between the minimum position 74 and the maximum position 76 that is configured to vertically balance the end effector 22 that is supporting a payload 12 that weighs less than the maximum payload 12, but more than the minimum payload 12.

As shown in FIGS. 1 and 2, the end effector 22 may include controls 78 that are configured for remotely actuating the vertical actuator 52*a* and/or the balancing actuator 52*b*. More specifically, the controls 78 may include a selector 80 and a directional control 82. The selector 80 may be configured for selecting between having no payload 12 on the end effector 22 and/or between a plurality of other payloads 12 having differing weights. For example, if the operator operates the selector 80 to choose that the end effector 22 is not supporting a payload 12, the balancing actuator 52*b* moves the mobile counterweight 68*b* along the lever 60 to the minimum position 74 to balance the end effector 22. Likewise, if the operator operates the selector 80 to choose the maximum payload 12, the balancing actuator 52*b* moves the mobile counterweight 68*b* along the lever 60 to the maximum position 76 to balance the end effector 22, and the maximum payload 12. It should be appreciated that the selector 80 may be configured to move the balancing actuator 52*b* to any number of locations between the minimum position 74 and the maximum position 76 to statically balance any number of other payloads 12, as known to those skilled in the art.

In an alternative embodiment, the balancing cable 56 is operatively connected to the cable 34. Alternatively, balancing cable is replaced by the cable 34, such that the cable 34 is attached to the lever 60 at the attachment point 66. In this embodiment, the mass 11 is movable along the Z axis in response to the application of a force F applied directly to the mass 11. Likewise, the mass 11 is configured to remain statically balanced along the Z axis when the force F is removed.

The directional control 82 may be configured for selectively moving the payload 12 upward or downward along the Z axis. More specifically, if the operator decides that the end effector 22, and any associated payload 12, needs to move vertically upward, relative to the ground G, the operator operates the associated directional control 82 to actuate the vertical actuator 52*a*. As a result of being actuated, the vertical actuator 52*a* moves the vertical slide 54 vertically downward to move the end effector 22, and any associated payload 12, upward along the Z axis. When the vertical slide 54 moves vertically downward, the eighth pulley 32*h* also moves vertically downward. As the eighth pulley 32*h* moves vertically downward, the cable 34 is tightened between the first and second attachment points 66 to raise the end effector 22, and any associated payload 12, along the Z axis.

Likewise, as shown in FIGS. 1 and 2, if the operator decides that the end effector 22, and any associated payload 12, needs to move vertically downward along the Z axis, the operator operates the associated directional control 82 to actuate the vertical actuator 52*a*. As a result of being actuated, the vertical actuator 52*a* moves the vertical slide 54 vertically upward. When the vertical slide 54 moves vertically upward, the eighth pulley 32*h* also moves vertically upward such that the cable 34 is slackened between the first and second attachment points 66 to lower the end effector 22, and any associated payload 12, along the Z axis. When the operator wants to maintain the vertical position of the end effector 22, and any associated payload 12, the operator refrains from operating any of the directional controls 82 and the end effector 22, and any associated payload 12, remains in the same vertical position along the Z axis.

Figure 4:
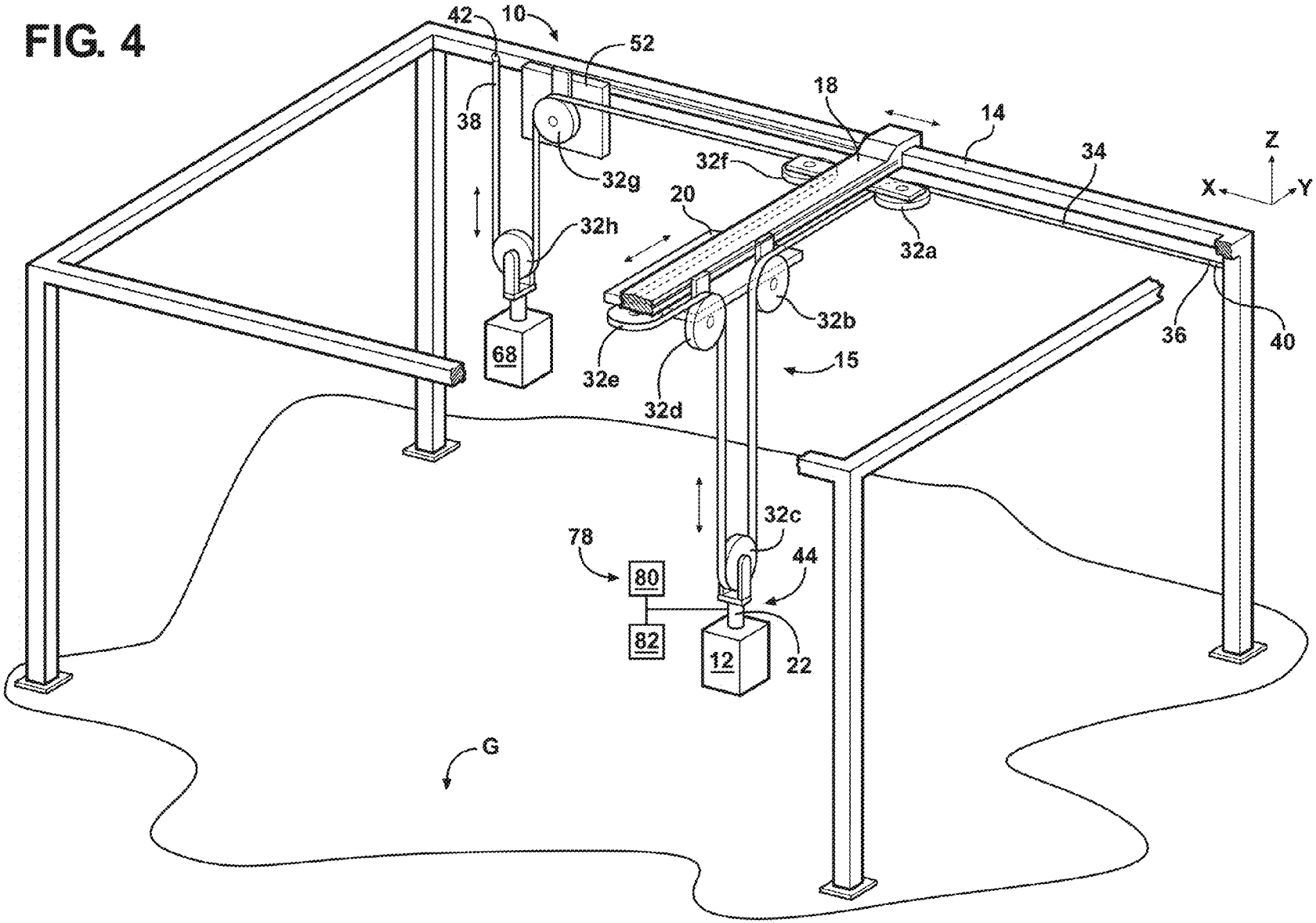
FIG. 4 is a schematic perspective view of another embodiment of the vertical actuation system configured for moving a mass along a Z axis.

Referring to the embodiment shown in FIG. 4, an actuator 52 extends from the support structure 14 and is operatively connected to the seventh pulley 32*g*. The cable 34 winds around the seventh pulley 32*g*. A counterweight 68 is supported by the eighth pulley 32*h*. The eighth pulley 32*h* is disposed along the cable 34 between the seventh pulley 32*g* and the second attachment point 66 such that the eighth pulley 32*h* and the counterweight 68 hang from the seventh pulley 32*g* and the second attachment point 66 to statically balance the weight of the end effector 22, and any associated payload 12. If the operator decides that the end effector 22, and any associated payload 12, needs to move vertically upward or downward along the Z axis, the operator operates the associated control and the actuator 52 is actuated in response. As a result of being actuated, the actuator 52 turns the seventh pulley 32*g* to move the cable 34 in a direction associated with moving the payload 12 in the desired vertical direction along the Z axis.

Figure 5:
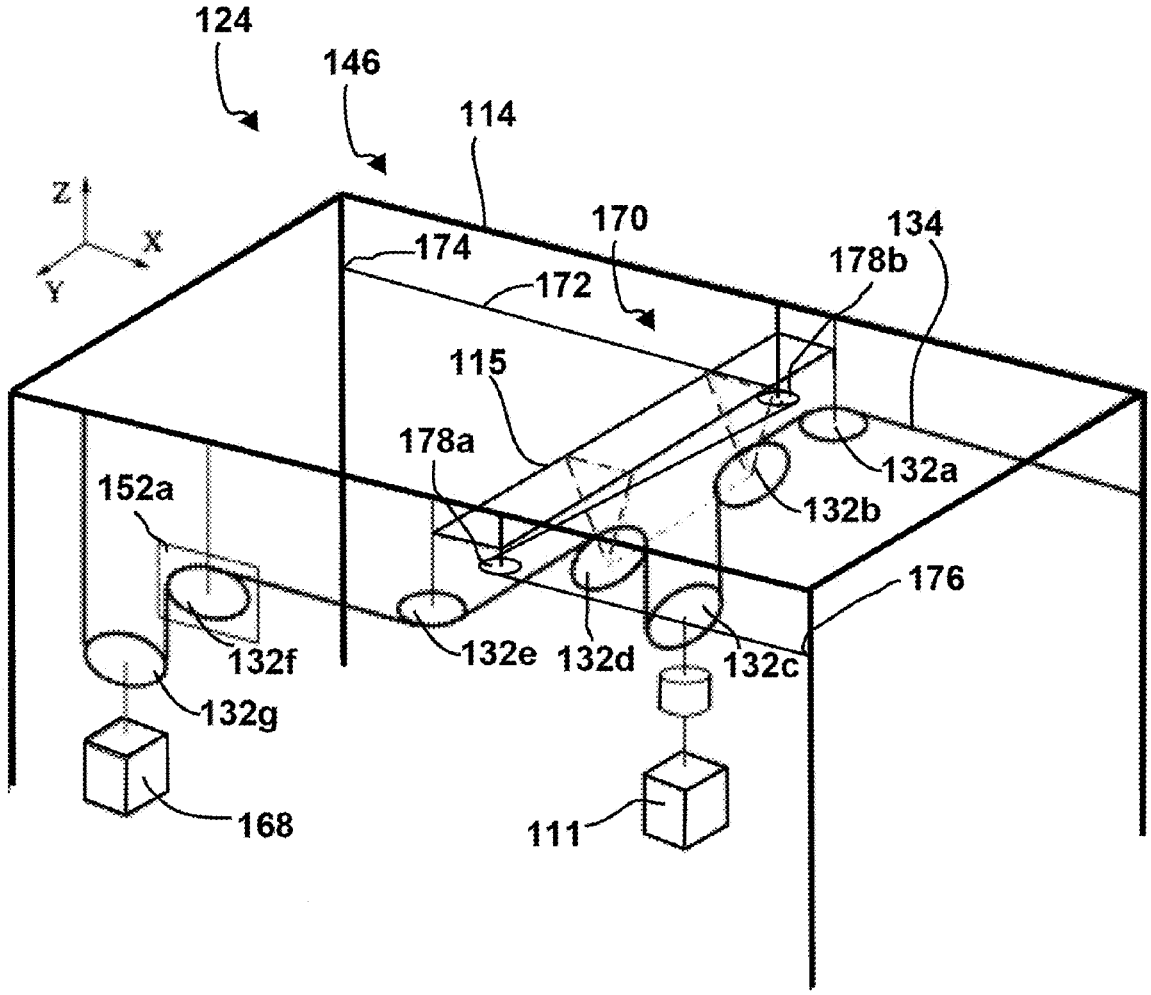
FIG. 5 is a schematic perspective view of a second embodiment of the vertical actuation system of FIG. 1, configured for vertically moving a mass along a Z axis.

Referring to FIG. 5, a second embodiment of an assist system 124 is shown. The assist system 124 includes a support structure 114, an assist device 115, a vertical actuation system 146, a counterweight 168, and a mass 111. The assist device 115 is operatively attached to the support structure 114 and is configured for moving the mass 111 horizontally along the X and Y axes. The vertical actuation system 146 is operatively attached to a support structure 114 and includes an actuator 152*a* that is configured to provide translational motion to the mass 11, vertically along the Z axis, via a cable 134 that is routed around each of a plurality of pulleys 132*a*-132*g*. To compensate for undesired torque that may be applied to the assist device 115 when moving the assist device 115 along the X and Y axes, a second cable routing 170 may be provided. The second cable routing 170 includes a second cable 172 that is secured to the support structure 114 at opposing ends 174, 176. A pair of second pulleys 178*a*, 178*b* are supported by the assist device 115 in spaced relationship to one another. The second cable 172 is routed around the second pulleys 178*a*, 178*b*, as shown in FIG. 5, in a Z-shaped pattern to compensate for any torque that may be applied to the assist device 115.

Figure 6:
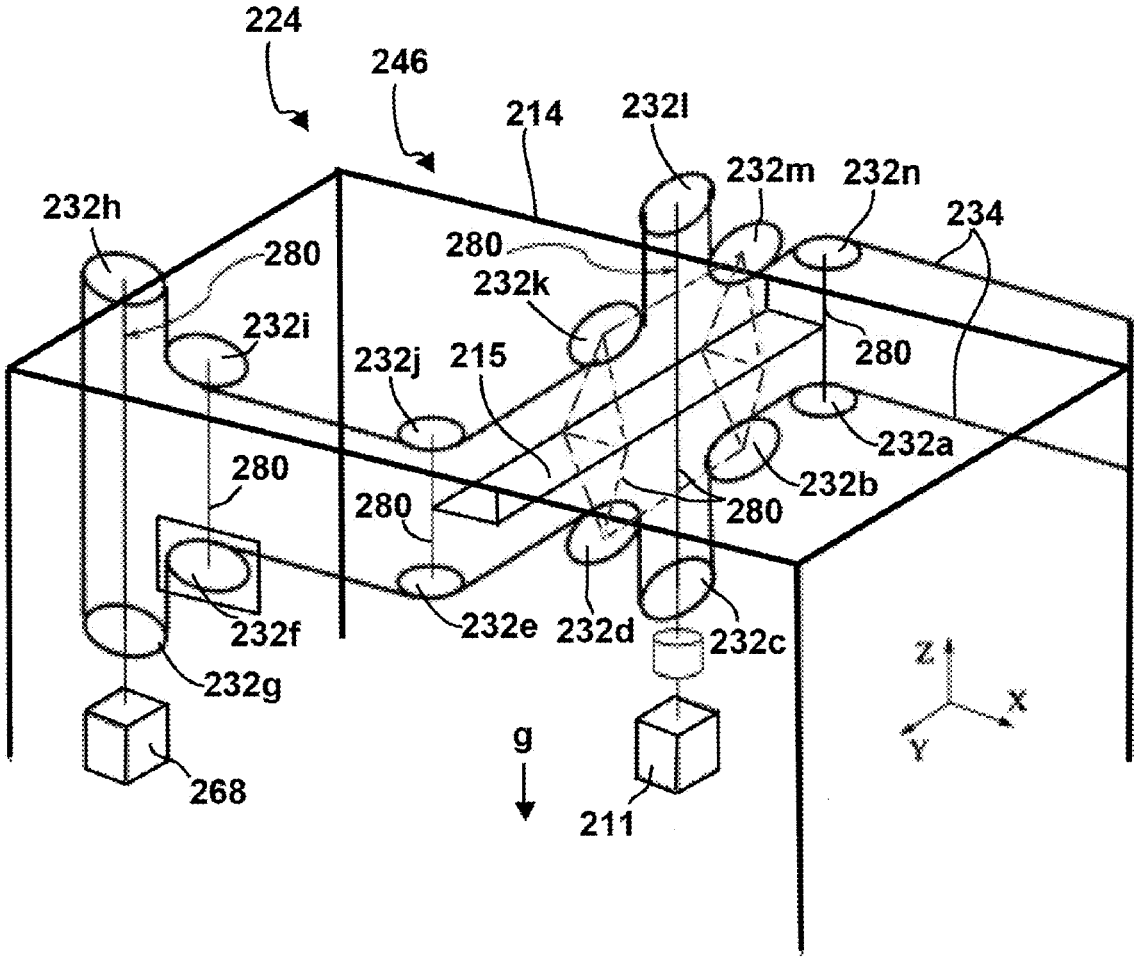
FIG. 6 is a schematic perspective view of a third embodiment of the vertical actuation system of FIG. 1, configured for vertically moving a mass along a Z axis.

Referring to FIG. 6, a third embodiment of an assist system 224 is shown. The assist system 224 includes a support structure 214, an assist device 215, a vertical actuation system 246, a mass 211, and a counterweight 268. The assist device 215 is operatively attached to the support structure 214 and is configured for moving the mass 211 horizontally along the X and Y axes. The vertical actuation system 246 is operatively attached to a support structure 214 and includes an actuator 252*a* that is configured to provide translational motion to the mass 211, vertically along the Z axis, via a cable 234 that is routed around each of a plurality of pulleys 232*a*-232*n*. The pulleys 232*a*-232*n* are configured to provide a "double routing" configuration as shown in FIG. 6. In the double routing, pulleys 232*a*-232*g* are disposed in mirrored relationship to pulleys 232*h*-232*n*, respectively. These pulleys 232*a*-232*g* and 232*h*-232*n* may be held in mirrored relationship to one another via rigid bars or links 280. However, they may also be held in mirrored relationship through any other mechanism known to those skilled in the art. A double routing may be used when a vertical acceleration g is larger than 1. Otherwise, the cable 234 may become slack when a vertical acceleration that is greater than 1 is applied. The double routing synchronizes motion of the mass 211 and the counterweight 268.

While the best modes for carrying out the invention have been described in detail, those familiar with the art to which this invention relates will recognize various alternative designs and embodiments for practicing the invention within the scope of the appended claims.

The invention claimed is:

1. A vertical actuation system comprising:

a cable having a first end and a second end;

wherein the first end is configured for operative attachment to a support structure at a first location and the second end is configured for operative attachment to the support structure at a second location, different from the first location;

a plurality assist device pulleys, a mass pulley, a fixed pulley, and an actuation pulley;

wherein the plurality of assist device pulleys are configured for operative attachment to an assist device that is movably attached to the support structure in a horizontal direction, relative to the ground;

wherein the cable is configured to be routed around each of the plurality of assist device pulleys, the mass pulley, the fixed pulley, and the actuation pulley such that each of the pulleys are configured to be operatively disposed between the first and second ends of the cable;

wherein the mass pulley is configured to be operatively supported by the cable and a pair of the plurality of assist device pulleys;

wherein the fixed pulley is configured for operative attachment to the support structure;

wherein the actuation pulley is configured to be operatively supported by the cable and each of the fixed pulley and the second end of the cable;

a mass extending from the mass pulley; and an actuator configured to move the cable relative to the fixed pulley such that the actuation pulley moves vertically, relative to the ground, as the mass pulley and the mass move vertically in an opposite direction;

wherein the vertical movement of the mass is configured to be independent of the horizontal movement of the assist device.

2. A vertical actuation system, as set forth in claim 1, wherein the actuator is operatively connected to the actuation pulley; and wherein the actuator is a vertical actuator configured for vertically moving the actuation pulley vertically along the Z axis as the mass pulley and the mass move vertically in an opposite direction.

3. A vertical actuation system, as set forth in claim 2, further comprising a vertical slide operatively attached to the vertical actuator;

wherein the vertical slide is configured to move along the vertical actuator in response to actuation of the vertical actuator.

4. A vertical actuation system, as set forth in claim 1, further comprising controls operatively connected to the assist device and configured to actuate the actuator.

5. A vertical actuation system, as set forth in claim 1, further comprising a variable balancing system including:

a balance platform and a lever pivotally attached to the balance platform about a balance axis;

a balancing actuator disposed along the lever;

a counterweight operatively attached to the balancing actuator such that the counterweight is configured to move a distance along the balancing actuator between a minimum position and a maximum position;

wherein the minimum position corresponds to the mass having a minimum weight such that the mass is statically balanced along a Z axis; and wherein the maximum position corresponds to the mass having a maximum weight such that the mass is statically balanced along the Z axis.

6. A vertical actuation system, as set forth in claim 5, further comprising a vertical actuation system operatively connected to the variable balancing system.

7. A vertical actuation system, as set forth in claim 5, wherein a balancing cable operatively interconnects the lever of the variable balancing system and the cable.

8. A vertical actuation system, as set forth in claim 5, wherein the actuator is operatively connected to the fixed pulley; and wherein the actuator is a rotary actuator configured for turning the fixed pulley to move the cable relative to the fixed pulley such that each of the actuation pulley and the counterweight move vertically as the mass pulley and the mass move vertically in an opposite direction.

9. A vertical actuationsystem, as set forth in claim 5, wherein the counterweight is a fixed counterweight and a mobile counterweight;

wherein the fixed counterweight is operatively attached to the lever such that the fixed counterweight does not move relative to the lever; and wherein the mobile counterweight is operatively attached to the balancing actuator such that the mobile counterweight is configured to move the distance along the balancing actuator between the minimum position and the maximum position.

10. A vertical actuation system, as set forth in claim 5, further comprising controls operatively connected to the assist device and configured to actuate the balancing actuator.

11. A vertical actuation system, as set forth in claim 1, wherein the plurality of assist pulleys are five pulleys.

12. An assist system configured to statically balance a mass in a vertical direction along a Z axis, relative to the ground, the system comprising:

a support structure;

an assist device movably attached to the support structure and configured for horizontal movement along at least one of an X axis and a Y axis, relative to the ground;

a variable actuation system including;

a cable having a first end and a second end, wherein the first end is operatively attached to the support structure at a first location and the second end is operatively attached to the support structure at a second location, different from the first location, a plurality assist device pulleys, a mass pulley, a fixed pulley, and an actuation pulley, wherein the plurality of assist device pulleys are operatively attached to the assist device;

wherein the cable is configured to be routed around each of the plurality of assist device pulleys, the mass pulley, the fixed pulley, and the actuation pulley such that each of the pulleys are operatively disposed between the first and second ends of the cable;

wherein the mass pulley is operatively supported by the cable and a pair of the plurality of assist device pulleys;

wherein the fixed pulley is operatively attached to the support structure;

wherein the actuation pulley is operatively supported by the cable and each of the fixed pulley and the second end of the cable;

a mass extending from the mass pulley; and an actuator configured to move the cable relative to the fixed pulley such that the actuation pulley moves vertically, relative to the ground, as the mass pulley and the mass move vertically in an opposite direction;

wherein the vertical movement of the mass is independent of the horizontal movement of the assist device.

13. An assist system, as set forth in claim 12, further comprising a rotary actuator operatively connected to the fixed pulley;

wherein the rotary actuator is configured for turning the fixed pulley to move the cable relative to the fixed pulley such that each of the actuation pulley moves vertically as the mass pulley and the mass move in a vertically opposite direction.

14. An assist system, as set forth in claim 12, further comprising a vertical actuator configured for vertically moving the actuation pulley vertically as the mass pulley and the mass move in a vertically opposite direction.

15. An assist system, as set forth in claim 14, wherein the vertical actuation system includes a vertical slide operatively attached to the vertical actuator;

wherein the vertical slide is configured to move along the vertical actuator in response to actuation of the vertical actuator.

16. An assist system, as set forth in claim 12, further comprising a variable balancing system including:

a balance platform and a lever pivotally attached to the balance platform about a balance axis;

a balancing actuator disposed along the lever;

a counterweight operatively attached to the balancing actuator such that the counterweight is configured to move a distance along the balancing actuator between a minimum position and a maximum position;

wherein the minimum position corresponds to the mass having a minimum weight such that the mass is statically balanced along the Z axis; and wherein the maximum position corresponds to the mass having a maximum weight such that the mass is statically balanced along the Z axis.

17. An assist system, as set forth in claim 16, wherein a balancing cable operatively interconnects the vertical actuation system and the lever of the variable balancing system.

18. An assist system, as set forth in claim 16, wherein the counterweight is a fixed counterweight and a mobile counterweight;

wherein the fixed counterweight is operatively attached to the lever such that the fixed counterweight does not move relative to the lever; and wherein the mobile counterweight is operatively attached to the balancing actuator such that the mobile counterweight is configured to move the distance along the balancing actuator between the minimum position and the maximum position.

19. An assist system, as set forth in claim 16, further comprising controls operatively connected to assist device;

wherein the controls are configured to actuate at least one of the actuator and the balancing actuator.

20. An assist system comprising:

a cable having a first end and a second end;

wherein the first end is configured for operative attachment to a support structure at a first location and the second end is configured for operative attachment to the support structure at a second location, different from the first location;

a plurality of pulleys configured for operative attachment to at least one of the support structure and an assist device that is movably attached to the support structure;

wherein the cable is configured to be routed around each of the plurality of pulleys;

wherein one of the plurality of pulleys is configured to be operatively supported by the cable;

a mass configured to extend from the one of the plurality of pulleys;

wherein another one of the plurality of pulleys is configured to be operatively supported by the cable;

wherein the vertical movement of the mass is independent of the horizontal movement of the assist device;

a variable balancing system configured to be operatively attached to another one of the plurality of pulleys, the variable balancing system including:

a balance platform and a lever pivotally attached to the balance platform about a balance axis;

a balancing actuator disposed along the lever;

a counterweight operatively attached to the balancing actuator such that the counterweight is configured to move a distance along the balancing actuator between a minimum position and a maximum position;

wherein the minimum position corresponds to the mass having a minimum weight such that the mass is statically balanced along the Z axis; and wherein the maximum position corresponds to the mass having a maximum weight such that the mass is statically balanced along the Z axis.

* * * * *